US006932172B2

(12) United States Patent
Dvorachek

(10) Patent No.: US 6,932,172 B2
(45) Date of Patent: Aug. 23, 2005

(54) ROTARY CONTACT STRUCTURES AND CUTTING ELEMENTS

(76) Inventor: Harold A. Dvorachek, 510 E. Jackson, Iola, KS (US) 66749

( * ) Notice: Subject to any disclaimer, the term of this patent is extended or adjusted under 35 U.S.C. 154(b) by 0 days.

(21) Appl. No.: 09/727,166

(22) Filed: Nov. 30, 2000

(65) Prior Publication Data

US 2002/0062996 A1 May 30, 2002

(51) Int. Cl.[7] ..... E21B 10/62
(52) U.S. Cl. ..... 175/432; 175/428; 175/379
(58) Field of Search ..... 175/327, 379, 175/425, 426, 428, 432, 434, 435

(56) References Cited

U.S. PATENT DOCUMENTS

| | | | | | |
|---|---|---|---|---|---|
| 3,075,593 | A | * | 1/1963 | Holsing | |
| 3,807,804 | A | * | 4/1974 | Kniff | 299/113 |
| 4,148,368 | A | * | 4/1979 | Evans | 175/374 |
| 4,199,035 | A | * | 4/1980 | Thompson | 175/413 |
| 4,339,009 | A | * | 7/1982 | Busby | 175/374 |
| 4,384,737 | A | * | 5/1983 | Reusser | 52/404.3 |
| 4,570,726 | A | | 2/1986 | Hall | |
| 4,595,067 | A | * | 6/1986 | Drake | 175/331 |
| 4,813,501 | A | | 3/1989 | Mills et al. | |
| 4,838,366 | A | * | 6/1989 | Jones | |
| 4,854,405 | A | * | 8/1989 | Stroud | 175/374 |
| 5,098,167 | A | * | 3/1992 | Latham | 299/104 |
| 5,248,006 | A | * | 9/1993 | Scott et al. | 175/420.2 |
| 5,678,645 | A | * | 10/1997 | Tibbitts et al. | 175/426 |
| 5,732,784 | A | * | 3/1998 | Nelson | |
| 6,283,234 | B1 | * | 9/2001 | Torbet | 175/413 |

OTHER PUBLICATIONS

Undated catalog pp. 3–5, 7–12, and 14 showing bits and blocks. A trademark K (stylized) appears on each page.

Undated catalog p. 15 showing drilling products. A trademark K (stylized) appears on the page.

Undated catalog pp. 12–17 showing conical cutter bits of various sizes. A trademark K (stylized) appears on some pages.

Undated catalog p. 18 showing soil stabilization tooling.. A trademark K (stylized ) appears on the page.

Undated , unnumbered catalog page or advertisement showing crusher/feeder breaker tooling.

* cited by examiner

*Primary Examiner*—John Kreck
(74) *Attorney, Agent, or Firm*—Edward L. Brown, Jr.

(57) ABSTRACT

Cutter elements including pointed contact structures and elements, and rock tools or bits for carrying those elements, for chipping, cutting, and breaking non-ductile materials are disclosed. The cutter elements, the ends of which directly contact and cut through rock and other materials, have tapered contact structure ends which are flatter than those known to the prior art, obtaining increased durability. The contact elements which may be part of the contact structures are selected of materials having hardness and other characteristics in relation to those of the mounting structures, including the tapered and projecting portions, which also add durability and wear-resistance to the elements. Fixed, replaceable, and rotatable cutter elements are disclosed. Rock tools including bits are also disclosed for carrying the cutter elements, having sockets for threaded or rotatable cutter elements arranged in straight or curved rows on the head opposite the drill-string-engaging base of the tool. The tool also has radially-extending buttresses which help to protect the cutter elements from damage as the drill string and head is withdrawn from a bore.

14 Claims, 14 Drawing Sheets

ROTARY CONTACT STRUCTURES AND CUTTING ELEMENTS

FIELD OF THE INVENTION

This invention relates to rotary tools used to drill, mill, or mine brittle formations, and it relates particularly to contact structures that are tapered and pointed and to cutting elements using such contact structures. Several new contact structures and cutting elements are disclosed, as well as a family of earth-boring bits and of bodies for earth-boring bits for best using such structures and elements.

BACKGROUND OF THE ART

The mining, construction, and drilling industries make extensive use of rotary tools. These tools apply intense loads to small areas to break brittle formations and structures into chips. Tapered cutting elements are commonly used for this purpose. Such elements are alternatively referred to as studs, buttons, cutters, cutting tools, and bits. A plurality of cutting elements may be attached to a holding tool. This tool may be a rotating drum, disc, or bit body. Such tools are used to mine minerals, cut trenches, mill pavement, drill holes, and the like.

A cutting element is a component of a cutting tool and is what contacts the formation being cut. The end portion of such a cutting element, which directly contacts the formation, is called the contact structure. Tapered cutting elements are well known, and they commonly have flat, rounded, or pointed contact structures. The principal, hardest, and most wear-resistant material of a contact structure is called a contact element, but adjacent parts of the end of the cutting element may also contact and help cut a formation, and not all contact structures have discrete contact elements. Cutting elements comprise at least a contact structure and a mounting structure. The mounting structure is used to mount and carry the contact structure, including any contact element. The mounting structure further comprises a holding structure and often a projection structure. The holding structure is the part of the mounting structure and the cutting element that is held in a cutting tool. When present, the projection structure is located between the contact structure and the holding structure. The projection structure distances the contact structure from the holding structure and thus from a surface of the cutting tool. The contact structure is then supported by the projection structure, and the projection structure is supported by the holding structure. When no projection structure is present, the mounting and holding structures merge together, and we speak of just the mounting structure as what carries the contact structure with respect to the cutting tool.

Typically, during use, only a portion of each contact structure is in contact with the formation at any given point in time. The size and the exact location of the area that is in contact with the formation depends on the design of the cutting element, the orientation of the cutting element with respect to the formation, the properties of the material being cut, and the operating conditions. Some portions of the contact structure are more likely than others to make contact with the formation being cut. The contact element is intended to be the first and principal point of contact with the formation, in normal use. Portions of the projection structure will rarely make contact with the formation being cut. Simple cutting elements may comprise only one part, made of one material, while more complex cutting elements may comprise more than one part made from several different materials, such as sintered tungsten carbide and steel. Usually the material of the contact element is harder and more resistant to abrasion than the material(s) of the projection structure and the mounting structure. The material(s) of the projection structure and mounting structure are often more ductile and resistant to impact than the material of the contact element. This selective use of materials in the prior art has improved performance of cutting elements while reducing their cost.

The properties, cost, and availability of sintered tungsten carbide make it the current material of choice for the majority of contact elements on most contact structures and cutting elements used in the construction, mining, and drilling industries. The sintered tungsten carbide used in such contact elements and structures is generally harder than Rockwell C 67. Many other materials are currently known that have similar properties to tungsten carbide but are not currently used to any significant degree. Some of the suitable materials are the oxides of metallic elements, the borides of metallic elements, the nitrides of metallic elements, the silicides of metallic elements, and the carbides of metallic elements. Steel is currently the material of choice for projection structures and for mounting structures, with hardness of less than Rockwell C 67. A harder surface treatment or coating may be applied to such projection and mounting structures.

FIG. 1 of the drawings shows a simple, prior art, tapered cutting element with a rounded contact structure 20, which has been in common use. It has a tapered mounting structure 22 and an adjoining holding structure 24. The contact structure comprises the integral rounded tip portion 20, without a separate contact element, and may include some or all of the tapered mounting structure 22. Any portion of the tapered structure that would only rarely contact the formation and is located between the contact structure 20 and the holding structure 24 is part of the projection structure. The included angle Φ1 of the distal end, taken from the tapered part below the rounded part, is acute. Cutting elements of this type are permanently installed. An interference fit between holding diameter D1 and the holding tool the usual method of retention. The ratio of the total length L1 to the holding diameter D1 is small, often approximately in the range of from 1 to 2. Simple cutting elements of this type are fabricated entirely from a single piece of sintered tungsten carbide.

FIG. 2 shows a more complex prior art cutting element that is also in common use in the art. It has two component parts, a contact element insert 26, which comprises much of the contact structure, and a mounting body 28, part of which is the holding structure 38 that is physically received inside a bit body. The holding structure 38 does not include a bit body socket rim bearing structure 36. The contact element 26 is shown assembled on the mounting body 28, on a common axis 30. The contact element 26 is part of the contact structure, and usually the contact element is made of tungsten carbide. Depending on the operating conditions and size of the contact element 26 in relation to an overall diameter D2, some of the contact structure may be located on the tapered portion of the mounting body 28, at 32, adjacent to the contact element 26. More rarely, some of the contact structure may be located on a portion of outside diameter D2. The projection structure on this cutting element normally includes the tapered face 32 of the mounting body 28 and the outside diameter D2 of this cutting element. The included angle Φ2 of the distal end of the cutting element is acute, as in FIG. 1. The distal end of the cutting element is shown as pointed, but it may sometimes be rounded. The mounting body 28 of the prior art cutting element of FIG. 2 is commonly made of steel.

The outside diameter D2 of the projection part of mounting body 28 in the FIG. 2 prior art device is larger than diameter D3 of an upper part of holding structure 38. A groove 34 is formed in the diameter D2 portion for engagement of a tool for removing the cutting element from a bit body. A bearing structure 36 is located at the base of the outside diameter D2. The holding structure 38 has two sections, one with the larger diameter D3 and another section with a smaller diameter D4. An additional groove 40 in the lower part of holding structure 38 facilitates engagement of a retainer for holding the cutting element rotatably in a bit body. The ratio of the overall length L2 of the cutting element to the largest holding structure diameter D3 is greater than 3.37 for known replaceable cutting elements.

Cutting elements used in the mining and construction industries are usually mounted so that they can be replaced when their contact structures become excessively worn. In the drilling industry, the vast majority of cutting elements now in use are not replaceable. Some can be sharpened. Usually, however, the entire drilling tool is replaced when the contact structures, contact elements, or cutting elements are significantly worn or damaged.

In the mining and construction industries, rotary tools are usually configured so that the cutting elements are rotatable about their long axes. The cutting elements and contact structures are angled backward from their direction of motion, and they also are angled to one side. These angulations cause each cutting element to rotate about its central axis when engaged, and so, as the sides of the contact structure wear, the original form of the contact structure is largely maintained.

A pointed end requires less force to initiate cracks in formations than other types of contact structure ends, because points best concentrate stresses. Such a pointed end also causes fewer unintended fractures in the material being cut than flat or rounded ends, making it the most energy-efficient type of cutter. Generally, in the mining and construction industries, large chips are desirable. Stresses are very high at the point of the contact structure, especially during impact with material being cut. The heat generated at the point is intense, and it may build up during times of continuous use. Abrasion at the point of a contact structure is much greater than on the flank of the contact structure, so the point can quickly become rounded. The point may also itself fracture. Designers have recognized these factors and have sometimes truncated the tapered end of the contact structure to create a cutting edge that is better supported and better cooled than a pointed contact structure. As the contact structure rotates in use, new portions of its cutting edge are presented to the material to be fractured.

In harder formations, nonetheless, pointed and truncated contact structures can be damaged so rapidly that they are impractical to maintain. This limitation has led to use of a radius or nose on the end of the contact element or structure, and the equipment employing such contact structures then applies higher forces. Several inventors have recognized these limitations, and patents have been issued for improvements in contact structures that help maintain the pointed form. Hard coatings have been applied as a means of extending the life of the point or the edge. Another approach has been to place a harder material in the center of the cutter that is supported by a softer, less wear resistant and more ductile material located radially outwardly from the center (U.S. Pat. No. 4,859,543). In these designs, both the harder and the more ductile materials have been made of sintered tungsten carbide with a cobalt binder. Tungsten carbides as hard as 88 Rockwell A have been used in these designs. Such designs have met with limited success, as the difference in hardness between the two grades of carbide used has not been great enough. Sintered tungsten carbide in grades as hard as 92 Rockwell A are readily available but are not known to have been used in either the center or outer structures. Contact stresses can fracture prior art contact structures.

Several patented bit designs use pointed contact structures. In one design, a number of angled replaceable cutting elements are rotatably attached to winged structures attached to a body (U.S. Pat. No. 5,735,360). Such elements are limited to larger bit sizes, and their use is limited to shallow holes in relatively soft formations. In another, somewhat similar design., a pilot cutter is located in the center of the bit (U.S. Pat. No. 3,720,273). The added center cutter gives this design better radial and axial stability than the pilotless type. These bits use a relatively compact cutting element compared to the cutting elements commonly used in mining machinery because of the limited space available on a bit. The numbers of cutting elements per unit of borehole area is relatively small, so the chips produced are relatively large. Typically for this type of bit the ratio of cutters divided by the cross sectional area of the bore has been approximately 0.2 cutters/square inch. At least one patented bit design uses pointed contact structures in rolling cones (U.S. Pat. No. 4,854,405). This design has not had been well accepted in the drilling industry, likely because in this type of bit the bearings wear out before the tungsten carbide cutting elements do.

Drag bits with flat contact structures having curved or straight cutting edges made of sintered tungsten carbide have been in use for many years. Within the last two decades, several new materials have been developed that can significantly improve the performance of these bits. The new materials are polycrystalline diamond and cubic boron nitride. The term polycrystalline is used to describe a multi-crystal composite material either with or without an additional material binding the individual crystals together. Polycrystalline materials can be fabricated into desired shapes and are much more resistant to impact damage than single diamond crystals. Polycrystalline diamond and cubic boron nitride are both substantially harder than impact grades of cemented tungsten carbide but are significantly less impact resistant. Of the two materials, polycrystalline diamond is the more commonly used material in the drilling industry. Contact structures of polycrystalline diamond have substantially increased the life of fixed cutting element drag bits, and they cut rock formations of increased hardness. The cost of polycrystalline diamond-coated contact structures is relatively high, and they are easily damaged and are generally not replaceable. At least one patent, however, appears for a replaceable diamond-coated contact structure (U.S. Pat. No. 4,782,903).

Polycrystalline diamond contact structures are bonded to tungsten carbide support structures to reduce the potential damage during use, to reduce cost, to facilitate processing, and to facilitate assembly. During use, polycrystalline diamond material has a tendency to delaminate from the tungsten carbide backing and to disintegrate. Many patents have been issued for improvements intended to reduce delamination and disintegration (e.g., U.S. Pat. No. 5,967,249). These bits are a vast improvement over bits that used single crystal cutting elements, which have been in use for over a century. These bits use the edges of the facets as cutting edges. Large numbers of diamonds are needed because the contact structures are small, they are irregular and the diamonds are brittle. As a result the chips cut from the formation face are very small, and chip flushing is poor. These bits cut very slowly and are currently used primarily for coring.

Several materials have been developed recently that show significant potential for use in contact structures. Two of these are carbon nitride and aluminum magnesium boride, but neither is available in such amounts as to presently allow their use commercially in contact elements.

SUMMARY OF THE INVENTION

It is an object of the present invention to provide a versatile family of rock and formation drilling bits that out-performs existing bits in a variety of conditions, both physical and economic. This object is achieved by using any of several different contact structures and any of several different cutting elements that could be utilized in an otherwise generally conventional bit design. A bit body and bit tool are disclosed for use of these cutting elements.

Three different contact structures are disclosed. Each is adapted to different conditions, and they differ in cost. The first contact structure design is adapted for use in soft formations and shallow holes. This is the simplest and should cost the least. A second contact structure is adapted to cut deeper holes into soft and medium formations, and should cost more than the first design due to its increased complexity. A third design is the most complex and is adapted to cut soft, medium, and medium hard formations, and will cost the most of the three.

Five kinds of cutting elements also are described. The first two embodiments are simple, fixed cutting elements, which are best adapted to small bit diameters and shallow drilling. The second and third embodiments are replaceable, although fixed cutting elements that are best adapted to small bit diameters and shallow drilling; the third embodiment may alternatively be disposable when thoroughly worn out. The fourth embodiment has a tapered, threaded holding structure for threaded engagement and replacement in a bit body. The fifth embodiment is a rotatable contact structure that is best adapted for larger bit diameters and deeper holes.

New holding tools or bits for these cutting elements and contact structures also are disclosed here but are claimed in a separate patent document. These tools or bits carry a number of cutting elements in novel ways.

Most of these cutting elements are replaceable, so that bits using them can be rebuilt instead of scrapped. The cost of replacing cutting elements is a significant part of the cost of drilling, so all the embodiments of the invention will reduce the cost of drilling and cutting rock. Other objects of this invention are to provide improved drilling and cutting speed, reduced potential for damage to the bit, improved cutting stability both axial and radial, increased cutting element life, reduced potential for clogging, and lower bit cost per foot of hole drilled.

THE PREFERRED EMBODIMENTS

Both new contact structures and new cutting elements using them are disclosed and claimed in this document. Also disclosed here are new bit bodies in which the cutting elements and contact structures are preferably used; these bit bodies are claimed here in combination and alone in another patent document filed simultaneously herewith.

Figure 1:
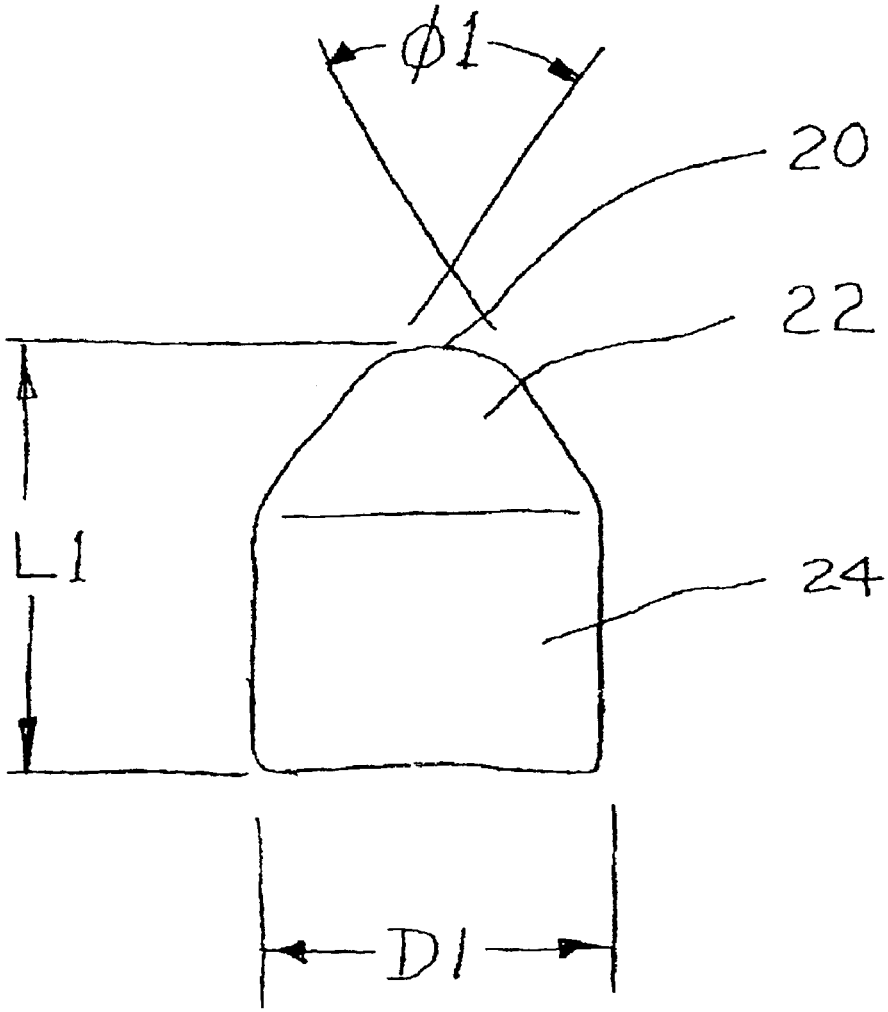
FIG 1 PRIOR ART
FIG. 1 is a side view of a simple prior art, tapered and rounded cutting element.
Figure 2:
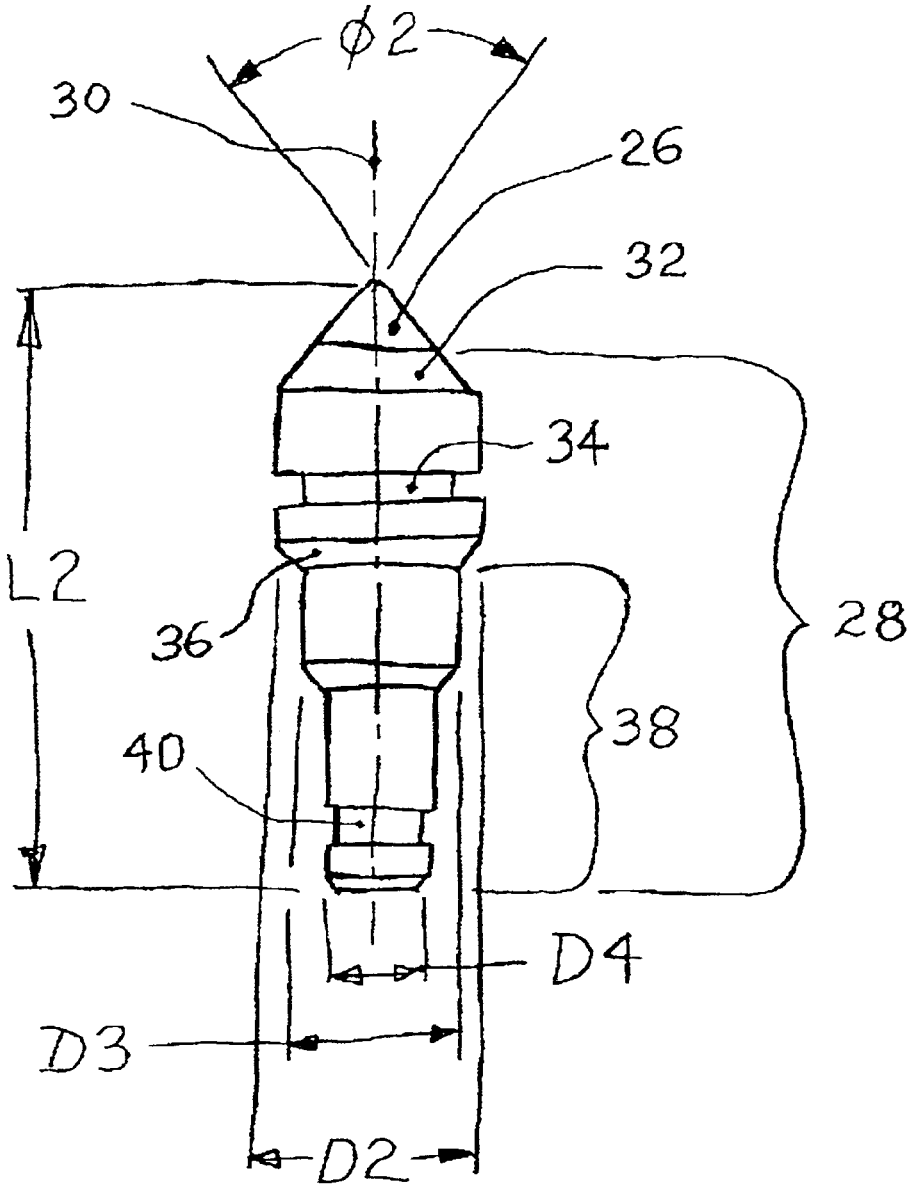
FIG 2 PRIOR ART
FIG. 2 is a side view of a relatively complex prior art pointed cutting element.
Figure 3:
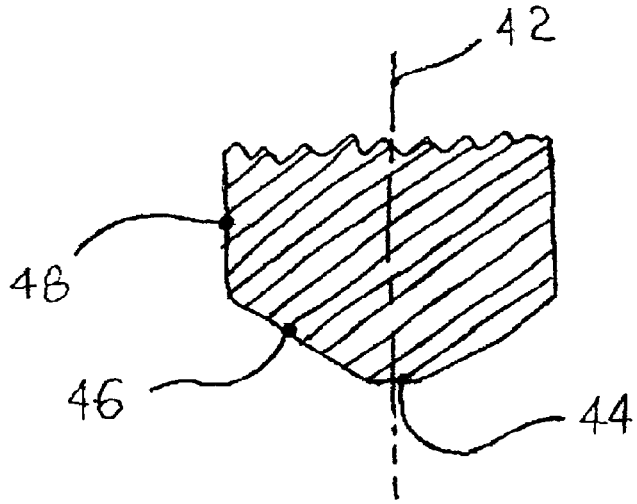
FIG. 3 is a cross-sectional view through the axis of a first embodiment of a contact structure in accordance with the present invention.

FIG. 3 is a partial cross section of a first embodiment of a contact structure of the invention and a portion of a projection structure 48 of a cutting element. The contact structure and cutting element are fabricated from one material. This is the simplest embodiment of the present invention. The cross section is taken along the central axis 42 of the contact structure, which is generally radially symmetrical. A tip 44 at the distal end, a tapered face structure 46 extending from the distal end, and part of a projection or mounting structure 48 are shown.

The tip structure 44 in this embodiment is shown as flat because it is not possible to make a perfect point or edge in any material. Additionally, at some level of size for any given job, sharpness of the point ceases to be a factor in how well the contact structure tip actually cuts or chips material. In any event, it is sometimes advantageous to limit the sharpness of the tip structure 44, as is shown in FIG. 3.

In the present invention, the contact structure includes the tip structure 44 and at least a portion of the conically tapered structure 46; surface 46 may alternatively be stepped or have another configuration. On rare occasions a portion of the projection structure 48, may also be considered a part of the contact structure. The tip structure 44 occupies a small to extremely small portion of the projected area of the distal end and may be slightly recessed or be raised, rounded, convex, concave, irregular, flat, polygonal, be a combination of the above, or have another configuration.

The sides of the tapered structure 46 extend at an included angle Φ (not shown) at the tip that is preferably greater than 90 degrees. As the angle Φ increases, making the contact structure 44, 46 flatter, the support for the tip 44, where the stresses and abrasion are the greatest, also increases. Making the contact structure 44, 46 flatter allows the use of harder, more brittle materials at the tip 44 that are more wear resistant.

Harder and more brittle materials give the contact structure 44, 46 the capacity to cut harder rock materials. The larger part of the contact structure 44, 46 must be significantly harder and stronger than the material being cut. Two preferred materials for the major portion of the contact structure 44,46 are polycrystalline diamond and polycrystalline cubic boron nitride. At least a portion of the contact structure should be harder than 67 on the Rockwell C scale. Testing of prototype samples has shown that when two different materials are used in a single contact structure that there must be a significant difference in the hardness to have a significantly beneficial effect on the wear of the contact structure. It is found that a difference of at least 300 points on the Vickers scale is needed to have the desired effect, assuming all other wear factors are the same; the hardness of the second material should be at least 1000 points on the Vickers scale.

Figure 4:
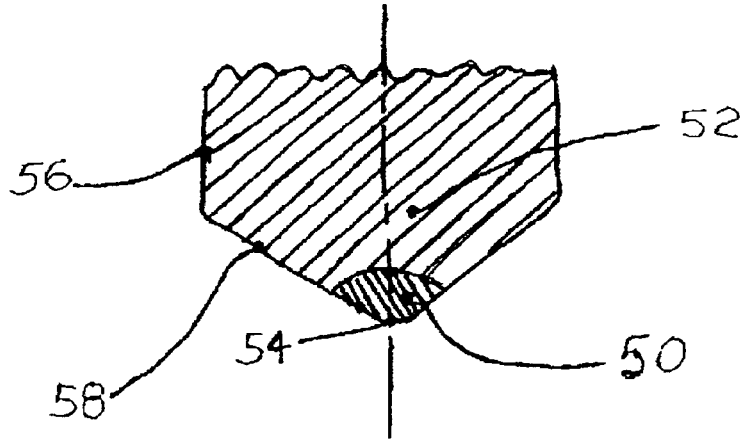
FIG. 4 is a partial cross-sectional view through the axis of a second embodiment of a contact structure, with a separate contact element, in accordance with the present invention.

FIG. 4 shows a contact element 50 and an end of a cutting element of a second embodiment, similar in shape to the contact structure shown in FIG. 3 but fabricated from two different materials. A first material 50, such as polycrystalline diamond or polycrystalline cubic boron nitride, provides or forms the contact element 54, at the tip, and a second material 52, such as cemented metal carbide, which forms the projection structure 56 and the tapered face feature 58. The second material supports the first material 50 through chemical, metallurgical, or mechanical bonding or through an engaging structure (not shown) as in FIG. 8, at 102, below. Welding, sintering, and brazing are suitable methods of attachment also.

Figure 5:
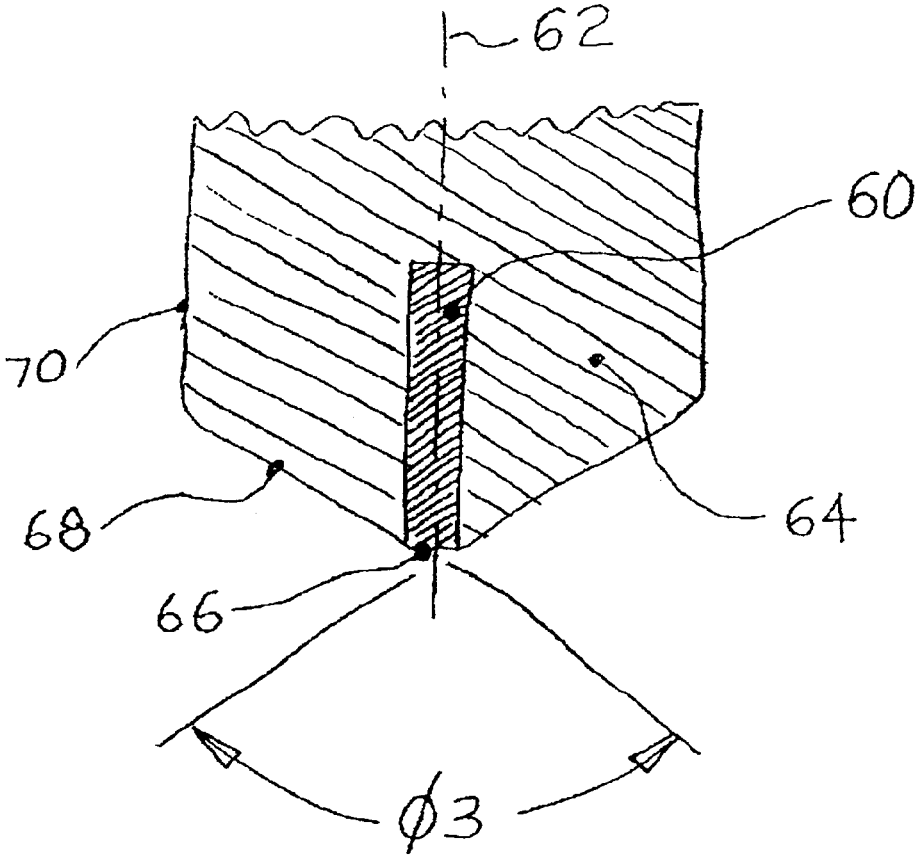
FIG. 5 is a partial cross-sectional view through the axis of a third embodiment of a contact structure and contact element in accordance with the present invention.

FIG. 5 shows an embodiment of the present invention that includes a contact element column 60 of very hard material, such as polycrystalline diamond or polycrystalline cubic boron nitride, that is configured along the axis 62 of the structure. A second material 64 such as cemented metal carbide surrounds the column 60, and there is a metallurgical bond between the two materials. The contact element column 60 is composed of a material that is extremely hard and wear-resistant, with great compressive strength but not high impact resistance. The present invention makes best use of available materials for the contact structure. Column 60 is located in the position of the most extreme compressive stress and also the most extreme wear, to take advantage of the extreme compressive strength and wear resistance of the material selected. The contact element column 60 is then surrounded by the more impact resistant material 64 such as cemented tungsten carbide, to maximize support for this material. The cross sectional area of the column of material 60 is preferably less than about 10 percent of the largest cross-sectional area of the shoulder of the cutting element. The contact structure 66, 68 includes the tip structure 66 and at least a portion of the tapered face structure 68. On rare occasions, a portion of the projection or mounting structure 70 may be intended to contact the face of the material being cut, and then it also is part of the contact structure.

Figure 6:
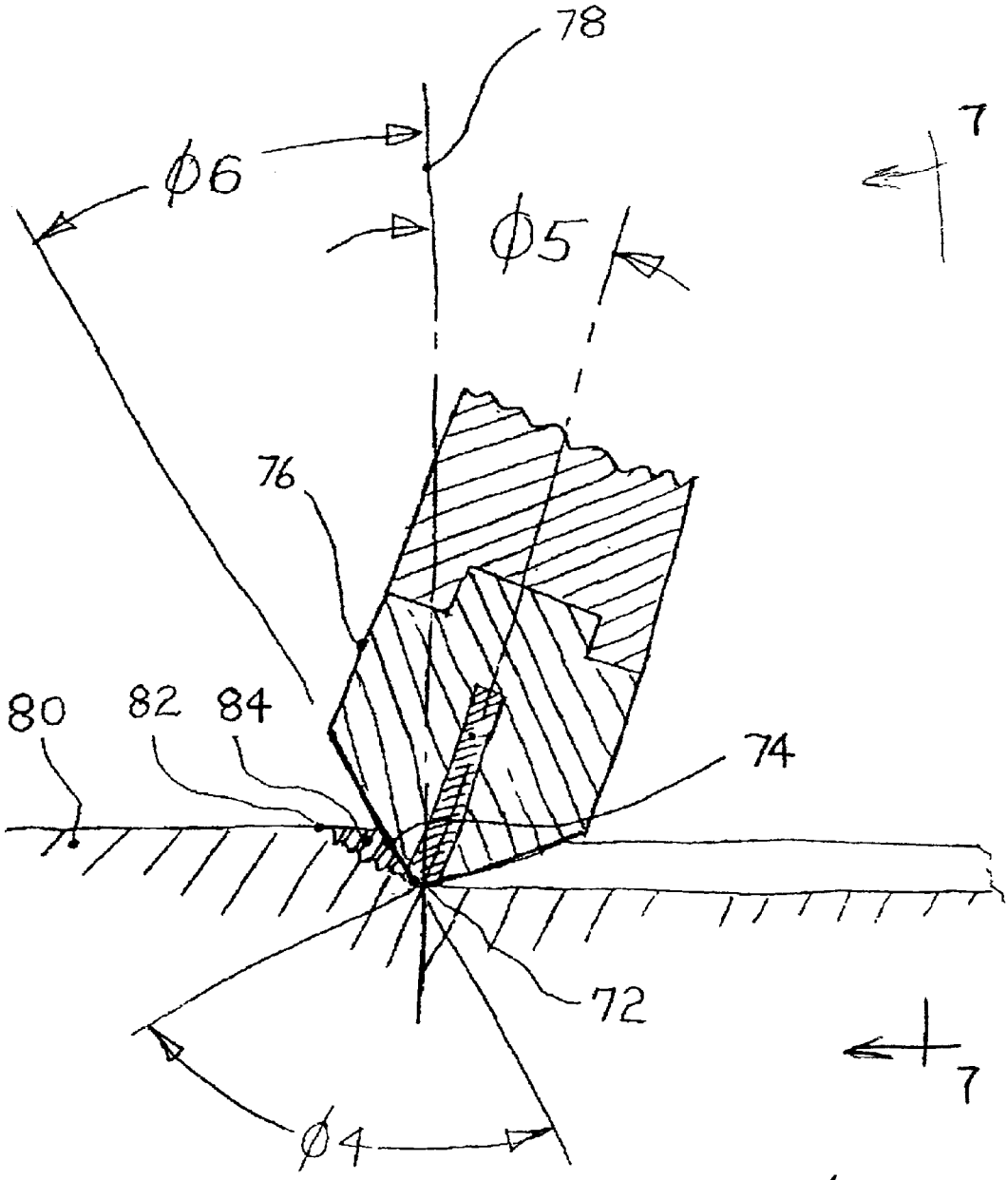
FIG. 6 is a partial sectional view through the axis of a leading cutting element located in a mid-portion of a bit engaged in and cutting a formation. The cutting element is shown moving from the right side of the figure to the left.

FIG. 6 is a side view of a cutting element that includes contact structure 72, 74. The projection structure 76 is not a portion of the contact structure in this embodiment. The cutting element is moving to the left in the figure, engaged with and cutting a formation 80. A fracture 82 is shown in formation 80, creating a chip 84 in front of the moving contact structure 72, 74.

Angle Φ4 of the cutting element in FIG. 6 is the included angle of the distal end. The angle Φ4 is generally more than 90 degrees and less than 150 degrees. Angles Φ5 and Φ6 show two different angles that the cutting element makes to a perpendicular 78 to the face of the formation or bore. Deploying the contact structure at an angle to the face of the bore can be useful in several ways. Angle Φ5 shows how much the cutting element is angled forward or backward. FIG. 6 shows the contact structure angled back. This gives the contact structure 72,74 more support from behind. This angle can be positive or negative and can vary from 0 degrees to 45 degrees. Angle Φ6 is the rake angle of the lead portion of the face 3 of the cutting element. The rake angle Φ6 can be either positive or negative. As angle Φ6 decreases, support for the tip structure increases.

Figure 7:
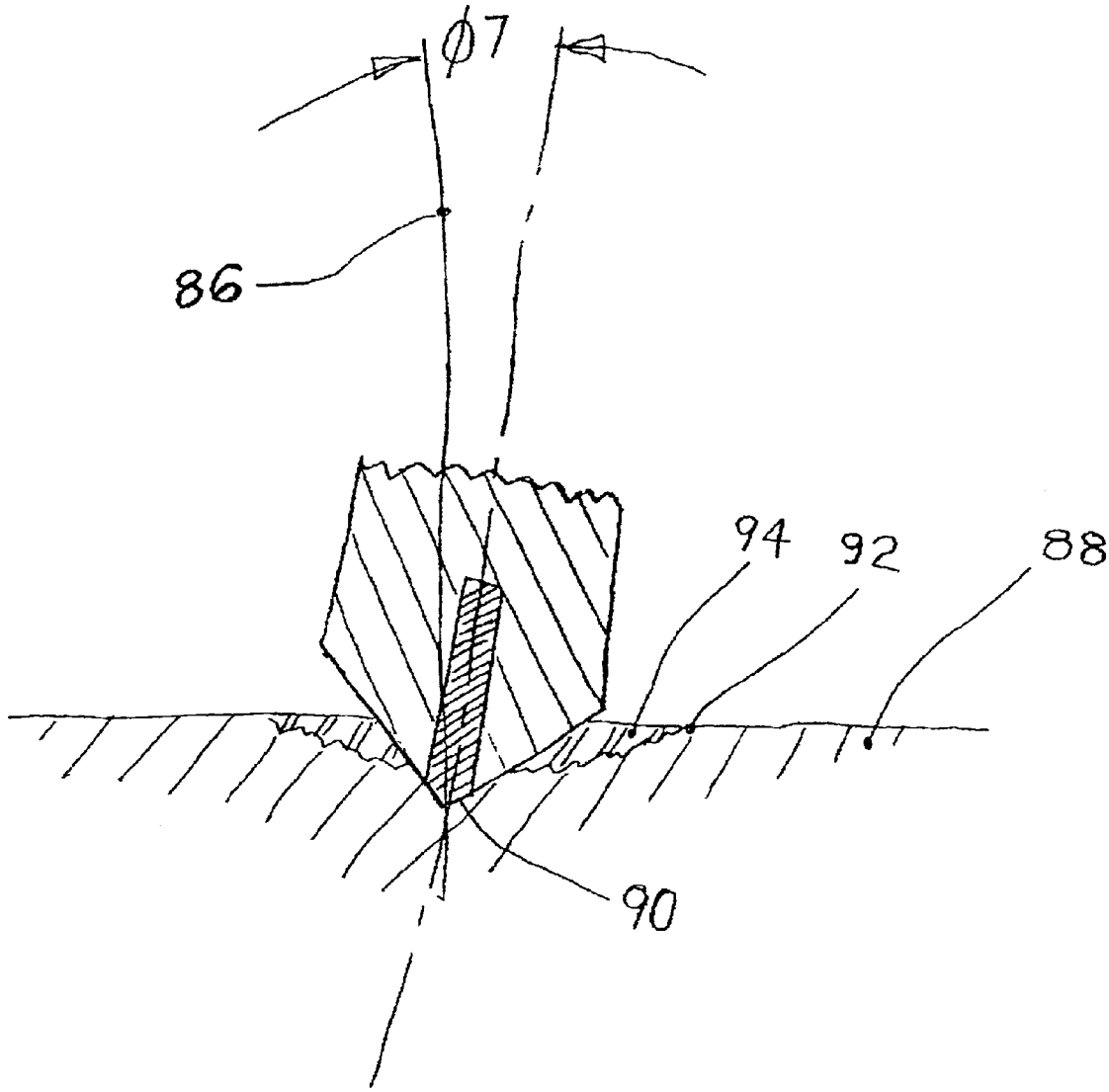
FIG. 7 is a partial sectional view through the axis of a leading cutting element located in a mid-portion of a bit engaged in and cutting a formation. The cutting element is shown moving away from the viewer.

In FIG. 7, angle Φ7 measures how much the cutter is tilted to either side. It can be positive or negative from the vertical 86, which here is also normal to the surface of formation 88. The movement of the cutting element while tilted at angle Φ7 to the side of the vertical 86 can promote rotation of the cutting element about its own axis. When the cutting element is located on the outside of the bit it can also help support the tip of cutting element 90. Fractures 92 and chips 94 that have just formed are shown on both sides of the cutting element.

In prior art bits the sum of angle Φ5 and angle Φ7 shown in FIGS. 6 and 7 has been approximately 90 degrees (see U.S. Pat. No. 4,813,501). In the present invention, this angle is generally less than 60 degrees. This is an important innovation, permitting use of a larger included angle Φ4 in the contact structure 72, 74 and, thus, substantially more support for the tip structure 72 where support is needed most. Stresses and abrasion at the contact element 72 are much greater than at any other location. The added support allows the use of a very brittle material with high compressive strength such as polycrystalline diamond at this location. When polycrystalline diamond or other brittle material with high wear-resistance is used in the contact element 72, wear on the contact structure 72, 74 and adjacent parts of the cutting element is minimized. The stresses on the tapered mounting structure 74 are then made significantly less than those on the contact element 72, allowing a less wear-resistant and less brittle material to be used in the tapered mounting structure 74.

The use of two materials with different resistances to wear beneficially creates a structure that retains the desired form as it wears during hard use. In several of the embodiments of the present invention, different materials have been selected for this reason. The lower sum of Φ5 and Φ7 in the present invention also allows for a more compact design and a more compact arrangement of the cutting elements. Many patents have been issued that take advantage of different wear rates in different materials to maintain a desired form (e.g., U.S. Pat. No. 4,859,543). These other inventions all differ in the material used to maintain the form, the form that is being maintained, or in both.

Figure 8:
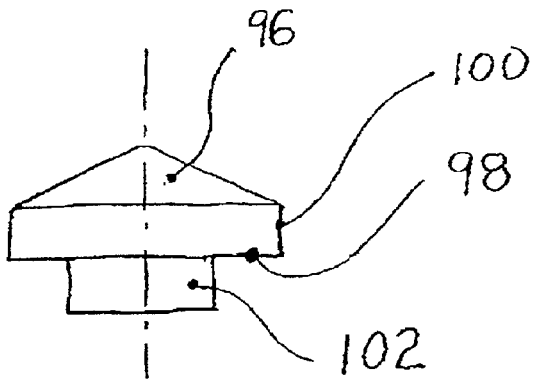
FIG. 8 is a side view of a first embodiment of a cutting element with a support structure and then a holding structure on the proximal end.

FIG. 8 shows a first form of cutting element that can embody any of the contact structures of the present invention, as shown in FIGS. 3, 4, and 5. The contact structure at a distal end 96 is unusually short and broad when compared to known contact structures. The distal end 96 of the mounting structure has also been broadened to protect the mounting structure from exposure to chips being flushed away from the bore face area. A bearing structure 98 adjoins a projection structure 100. This bearing structure supports the outer edge of the tapered mounting portion. In extremely soft formations, the projection structure 100 can engage the formation also, although it is not intended normally to do so. A holding element 102 is shown adjacent the projection structure, for facilitating assembly to a tool and to increase the shear and tensile strength of the joint between the contact structure and a bearing structure 98. It also facilitates the use of a softer, more ductile, and lower cost material in the mounting element. The cutting element of FIG. 8 can be mounted directly on and attached to a bit body, or it can be mounted on and attached to a mounting body to become a component of another cutting element.

Figure 9:
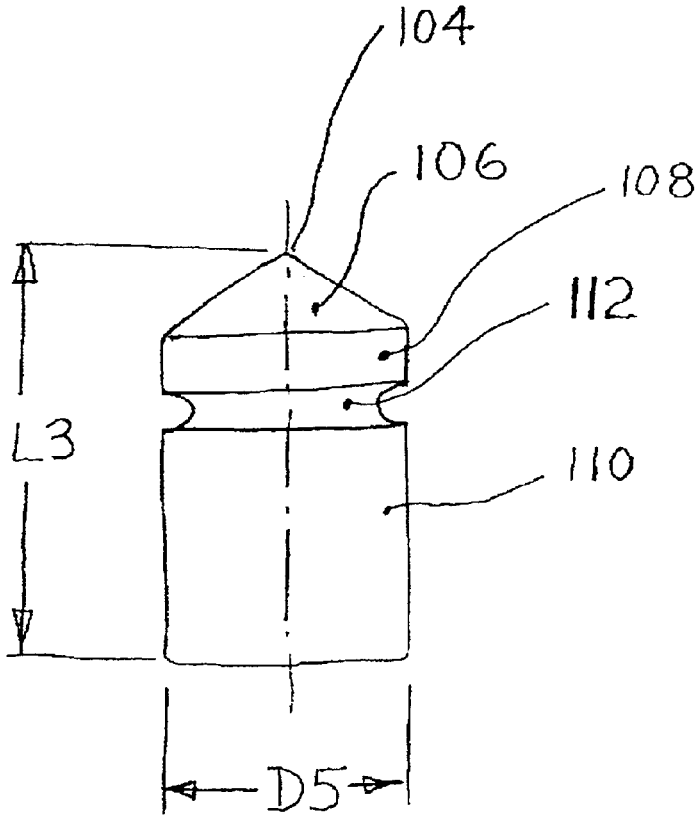
FIG. 9 is a side view of a second embodiment of a cutting element.

FIG. 9 shows a second embodiment of a unified cutting element. A contact structure 104, 106, a projection structure 108, and a holding structure 110 are fabricated from a single material, for assembly into a bit body by press fitting. The angle of the taper at the distal end is obtuse. A circumferential recess 112 is formed for the engagement of a removal tool (not shown). The recess 112 is a groove, but other forms can be used. The recess 112 is located in the projection structure 108. The ratio of the length L3 divided by the diameter D5 is between 1 and 3.25, making it an exceptionally compact cutting element when compared to typical other, prior art, removable, pointed cutting elements. The compactness allows more cutting elements to be used on a bit or other rotary cutting tool.

Figure 10:
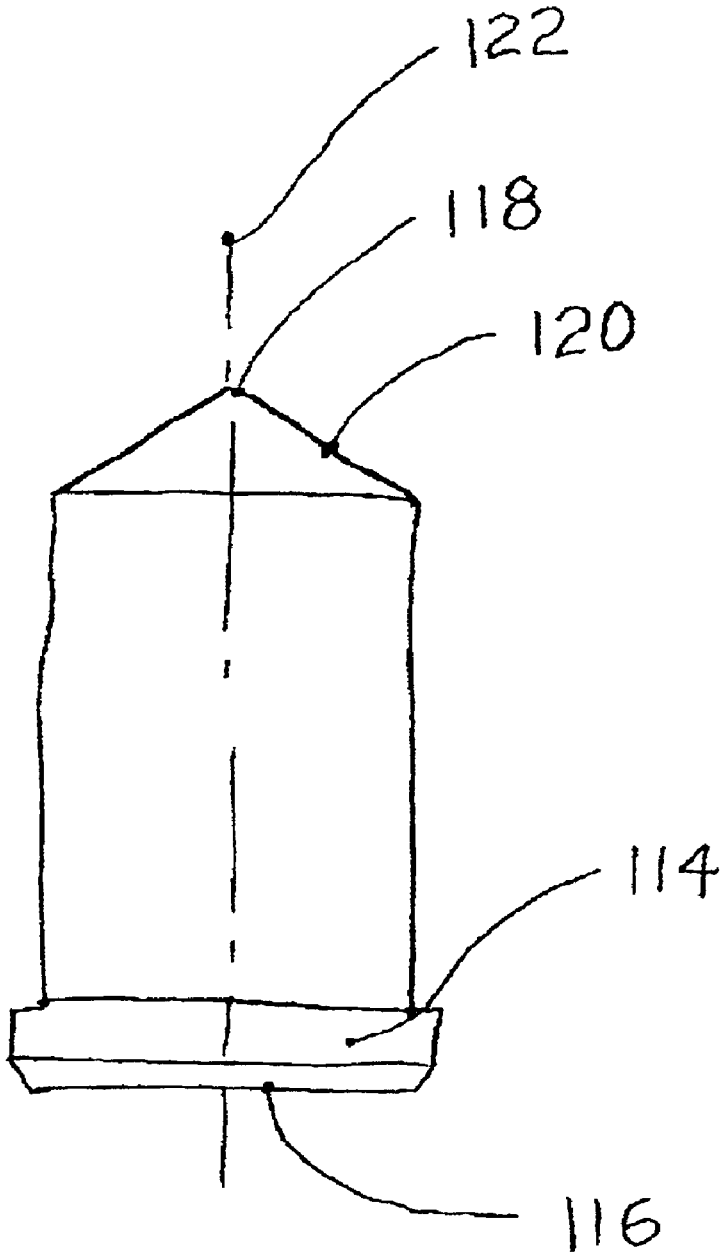
FIG. 10 is a side view of a third embodiment of a cutting element

FIG. 10 shows a third form of cutting element of the invention, similar to that of FIG. 9 except that a projecting holding structure 114 has been added. A recess as 112 in FIG. 9 is not used, but could be added. The projecting structure 114 can be engaged by a retaining element in a bit body. The projecting structure 114 is shown as a ledge, but other forms can be used. The use of a retaining element makes a contact structure as shown in FIG. 10 much easier to install and remove than would otherwise similar cutting elements that are pressed into place, as that in FIG. 9. The projecting structure 114 is located near the proximal end 116, but can be located anywhere below the contact structure 118, 120. A cutting element as in FIG. 10 can be either fixed or rotatable about its axis 122. The cutting element shown in FIG. 10 is also quite compact when compared to typical rotatable or removable pointed contact structures.

Figure 11:
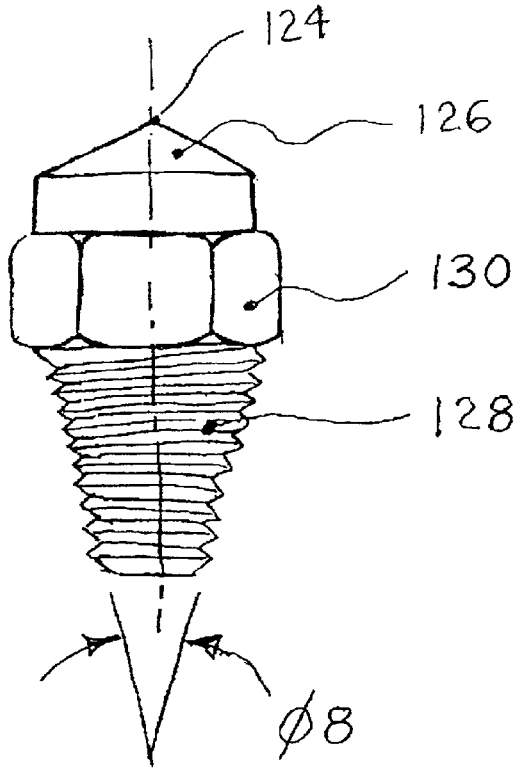
FIG. 11 is a side view of a fourth embodiment of a cutting element.

FIG. 11 shows a contact structure 124, 126 attached to a mounting structure in a third embodiment of the invention. The mounting structure comprises a threaded element 128 and a circumferentially engageable element 130, which permits grasping and turning the element, as with a wrench. The threaded element 128 is tapered at an angle Φ8. The tapered form of the threaded element 128 allows cutting elements to be assembled more closely to each other in a bit assembly. The increased cutting element density helps stabilize the bit while cutting, by distributing the imposed loads. It also allows for the alignment of cutting elements in rows. An additional advantage of the tapered, threaded holding structure 128 is that it is self-locking. In the present invention the angle Φ8 is between ½ degree and 60 degrees. The circumferentially engageable feature 130 is a hexagon, but other forms can be used. Cutting elements that are threadably engageable as in FIG. 11 are fixed and are not rotatable. The cutting element shown in FIG. 11 is also quite compact when compared to typical, removable, pointed cutting elements.

Figure 12:
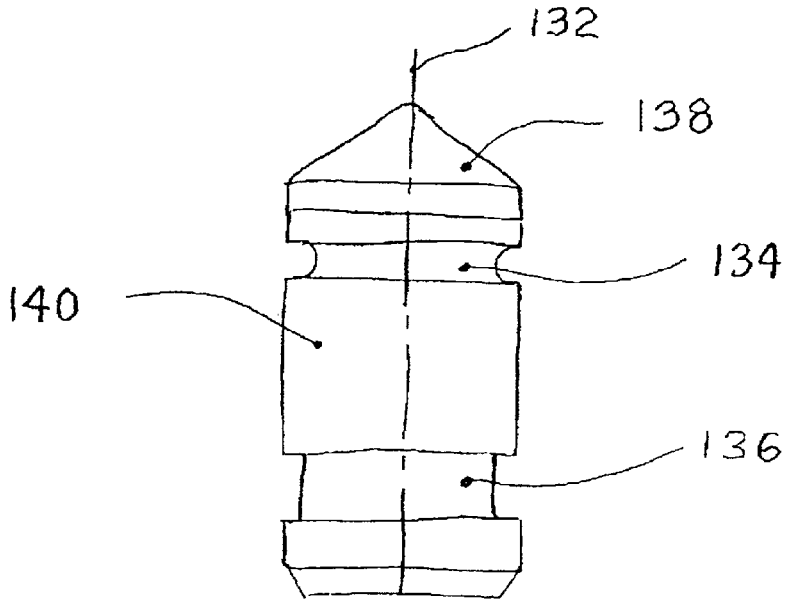
FIG. 12 is a side view of a fifth embodiment of a cutting element.

FIG. 12 shows a fourth embodiment of contact structures and cutting elements of the invention, with a cutting element that may rotate about its own longitudinal axis 132. A first axially engageable, circumferentially-extending recess 134, or a similar structure, is formed on the distal part of the cutting element. This recess 134 is engageable by a tool capable of applying force in the direction of the axis 132 of the element, for removal of the element from the bit or tool. A second axially engageable element 136 is located on the proximal, holding structure part of the element, for receiving a retaining element for fixing the cutting element in the bit or tool body. In FIG. 12, the cutting element is comprised of two components, a contact structure 138 and a mounting body 140, but a unified structure could equally be used. This embodiment is also quite compact when compared to typical, rotatable, pointed cutting elements known to the art.

Figure 13:
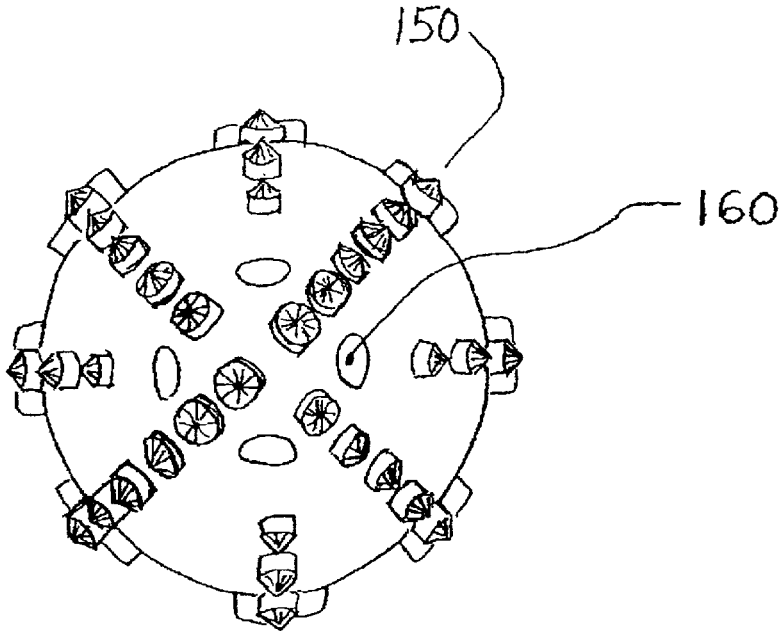
FIGS. 13 and 14 are top end and side views of an earth-boring bit embodiment of the present invention.
Figure 14:
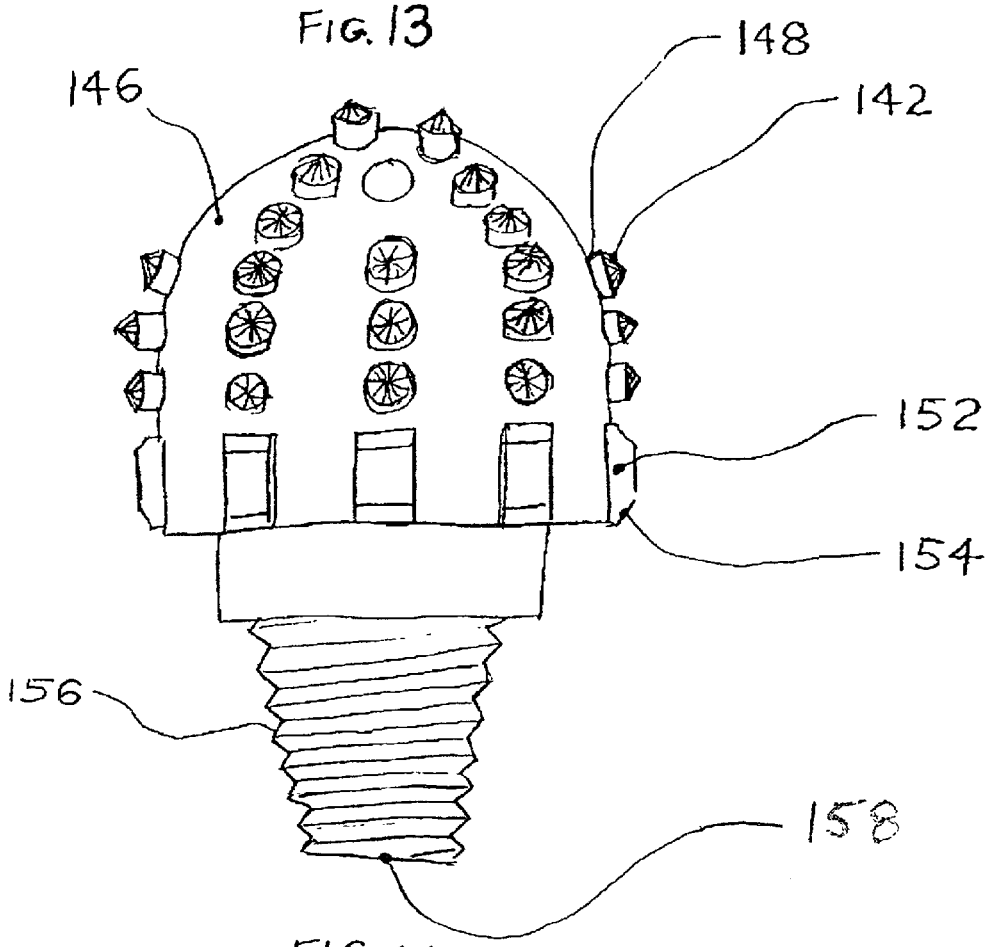

FIGS. 13 and 14 are top and side views of a novel earth-boring bit body 146 provided with contact structures 142 also according to the present invention. In this view the contact structures are not distinguishable, but are attached to projection structures 148 rising from the bit body 146. The contact structures 142 can be permanently attached or removable, and they may also be fixed or rotatable. The contact structures 142 may be an integral part of the bit body 146 or be attached to the projection structures 148. The projection structures 148 may be formed as integral parts of either the contact structures 142 or of the bit body 146. The projection structures 148, arrayed in rows 150, create a flow path for the cuttings to promote efficient fluid flow for debris removal, but they may be arranged in other patterns. The points of the contact structures 142 in each row 150 are arranged in simple arcs, but other forms of arrangement may be used. It is preferred that the sum of a backward angle plus a sideward angle of an axis of the cutter element, or a related socket in the bit body, from a perpendicular to the surface of the body, is less than 70 degrees.

Protective buttress elements 152 are formed on the bit body 146 in line with the rows 150 of contact structures 142 to protect the contact structures 142 from snagging as the bit is withdrawn from a hole. Chamfers 154 are formed on corners of the buttress elements 152. A holding structure thread 156 is shown on a tapered stem, and other holding means can be used. A fluid inlet 158 is formed in the stem, and multiple fluid outlets 160 are formed in the head 146 of the bit. At least one fluid outlet 160 per row 150 of cutting elements 142 is desirable.

In these FIGS. 13 and 14, the contact structures 154 are arrayed so that each extends generally perpendicular to the bore face. Alternatively, some or all of the cutting elements may be angled other than perpendicularity to the cutting face, as at angles Φ5 and Φ7 as shown in FIG. 6 and FIG. 7, discussed above. More than three contact structures 142 are arrayed perpendicularly to the borehole. These elements are generally redundant. They stabilize the bit radially and help to create a relatively smooth bore. Bits with few pointed cutting elements cut rough holes, reducing the effective diameter of the hole and substantially increasing the amount of cement required to form cemented casings (not shown).

Figure 15:
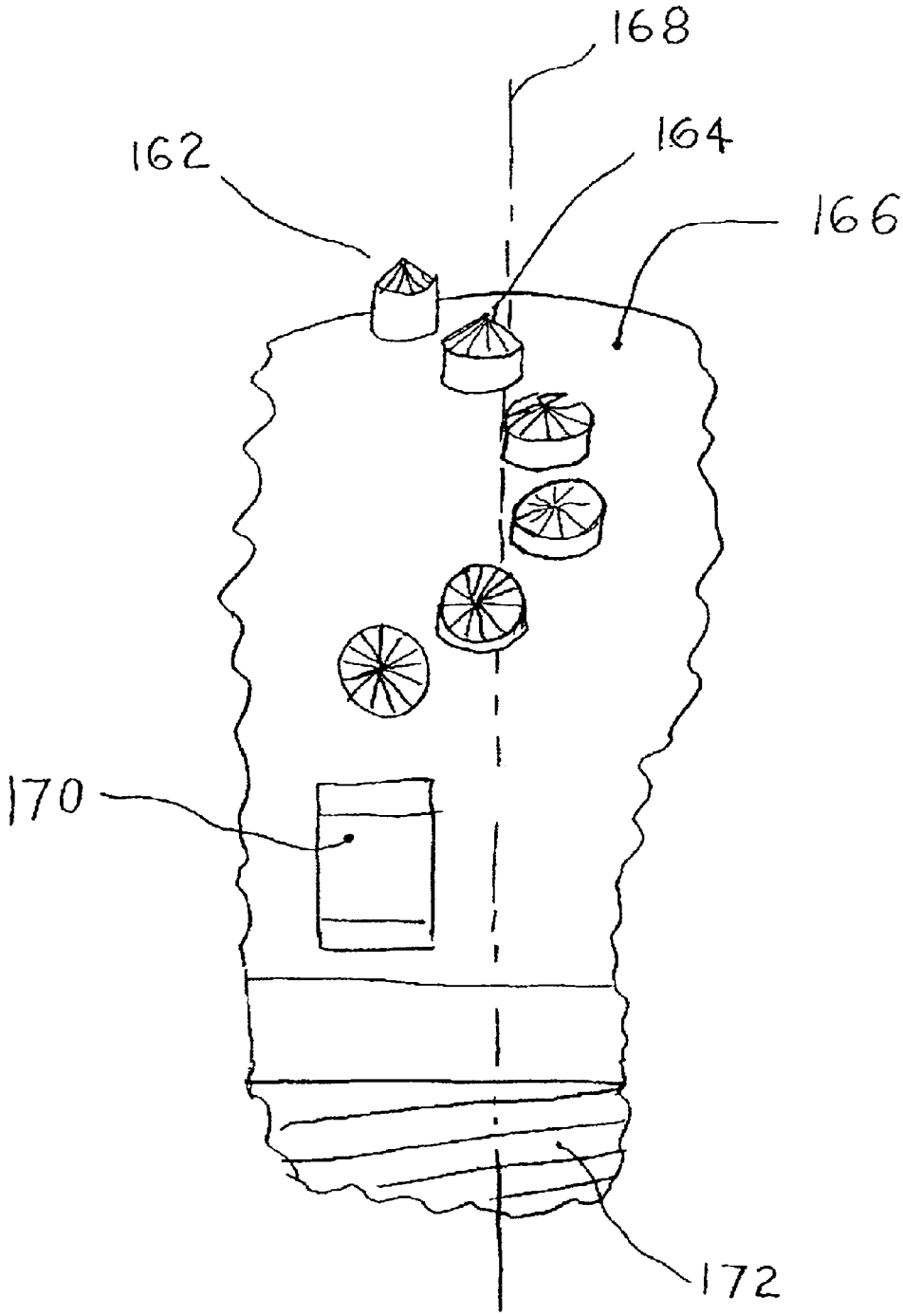
FIG. 15 is a partial side view of an earth-boring bit showing a row of cutters that is curved in two dimensions.

FIG. 15 is a partial side view of a bit with a row 162 of cutting elements 164, wherein the row is advantageously curved both parallel to the face 166 of the bit and backwards from the axis 168 of the bit. This arrangement may be described as spiral, or that the curves are in two dimensions on the surface of the curved body. Other curvatures can be used. Such curvatures allow closer radial spacing of the contact structures. They also allow the setting of the contact structures to "shade" a side portion of a following contact structure, changing the forces applied to the following structure to cause it to rotate or to prevent it from unscrewing. Also shown are a buttress 170 and a portion of a mounting thread 172.

Figure 16:
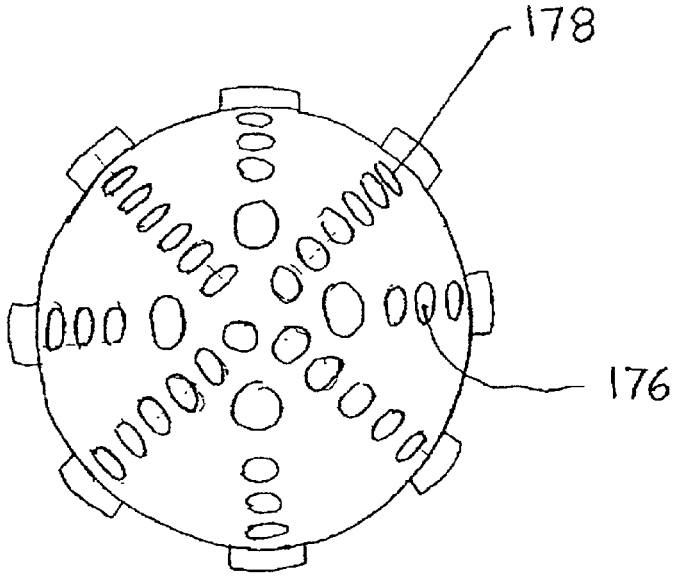
FIGS. 16 and 17 are top and side views of an earth-boring bit body embodiment of the present invention.
Figure 17:
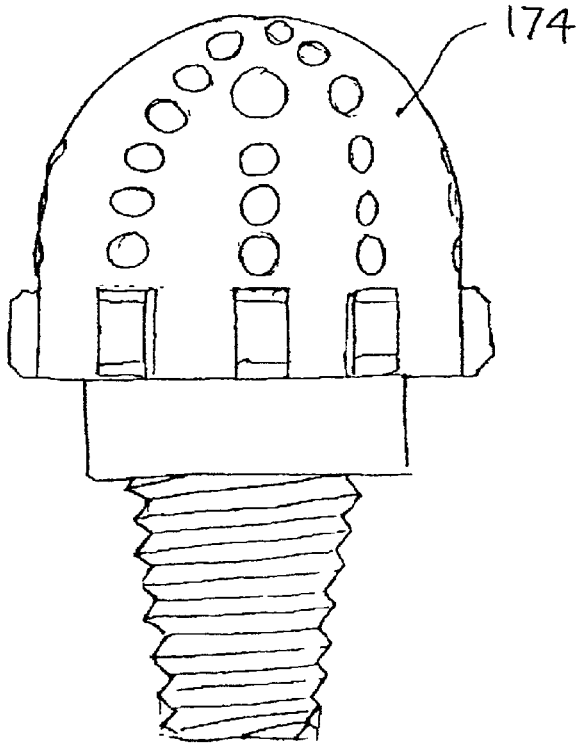

FIGS. 16 and 17 are respectively top and side views of the bit body 174 without contact elements. Sockets 176 are adapted for engagement of cutting elements according to the invention, or conventional ones with suitable mounting arrangements. The sockets 176 are arranged in rows 178 but can be arranged in other patterns. The sockets may be adapted for fixed or for rotatable mounting of the contact elements. They may also be adapted for threaded holding structures. The sockets may also be arranged perpendicularly to the bore face or angled away from perpendicularity to the bore face, as in FIGS. 6 and 7.

Figure 18:
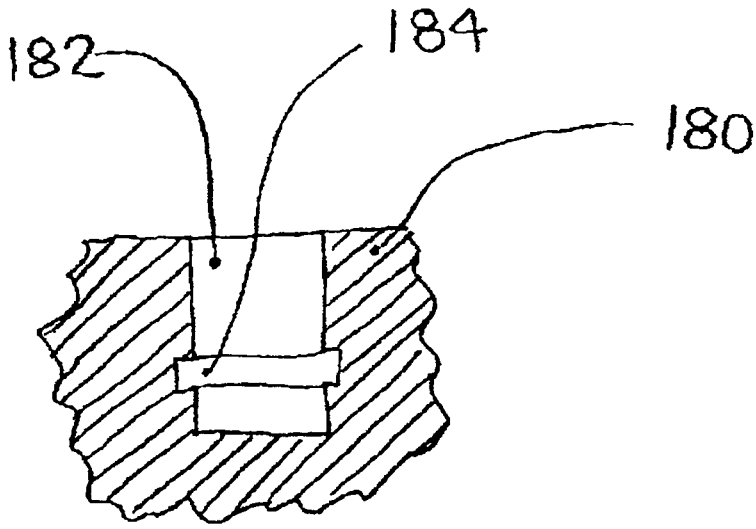
FIG. 18 is a cross section of a socket in an earth-boring bit body.

FIG. 18 is a partial sectional view of a bit body 180 through a socket 182, similar to a socket 176 in FIG. 16, that is adapted to receive a cutting element without threads. An undercut 184 is shown for the engagement of a retaining means for a cutting element. The undercut 184 is a circular groove, but other forms can be used. The undercut 184 can be located anywhere between the bottom to near the top of the socket.

Figure 19:
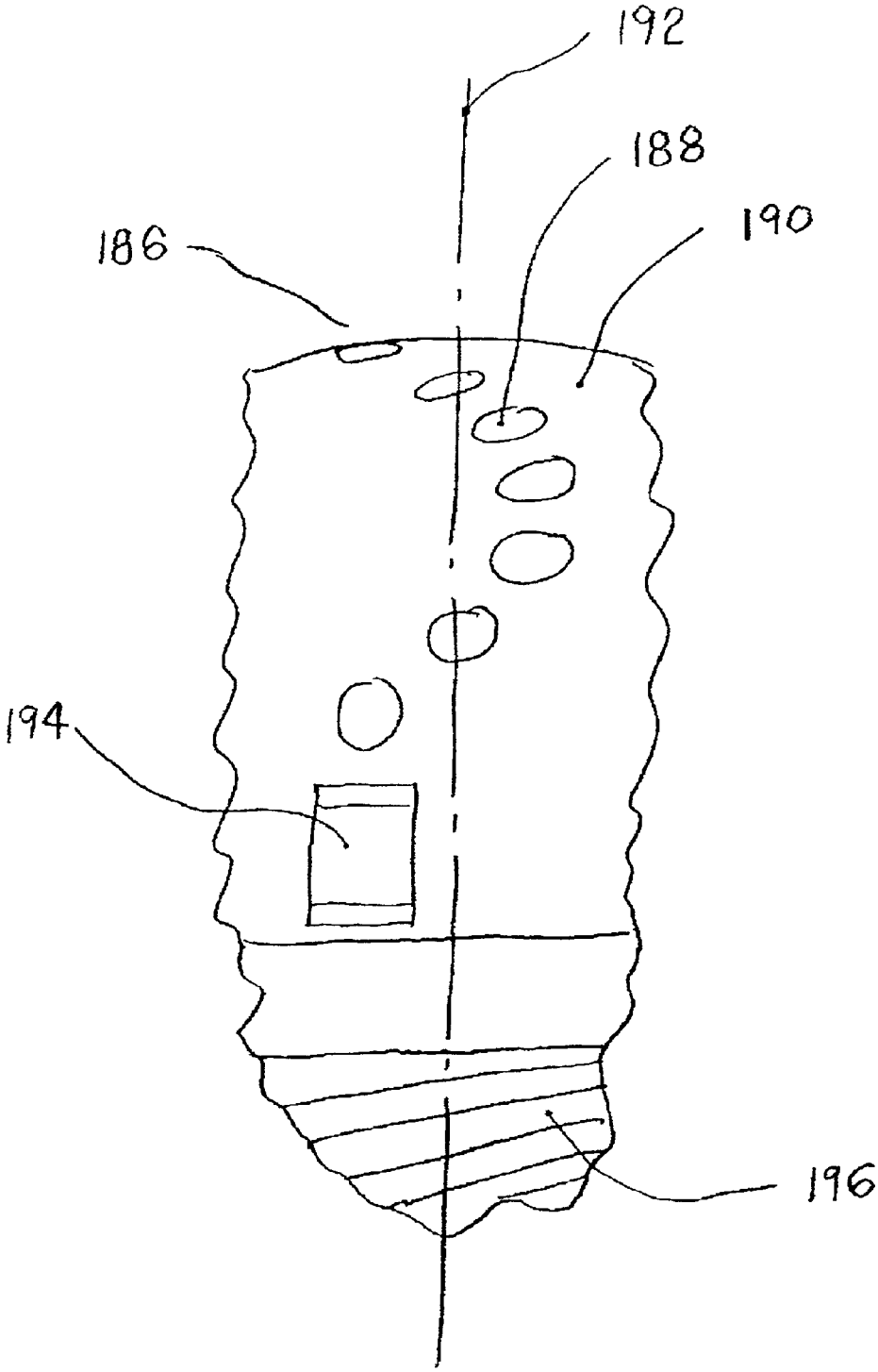
FIG. 19 is a partial side view of an earth-boring bit body showing a row of sockets that is curved in two dimensions.

FIG. 19 is a partial side view of a bit showing a row 186 of sockets 188 that is curved in more than one direction. The row 186 is curved in a direction that is parallel to the face 190 of the bit and in a direction that is backward from the axis 192 of the bit. Also shown are a buttress 194 and a portion of a thread 196.

Testing of prototype samples of the present invention have shown that the size of the chips is reduced when the number of pointed cutting elements per square inch of bore area is increased significantly above the number used in current state of the art bits. The smoothness of the bore also improves. It has been found that the desirable number is greater than approximately 0.33 pointed contact structures per square inch of the bore area (i.e., the area of the cross-section of the hole).

Many variations may be made in the invention as shown and its manner of use, without departing from the principles of the invention as described herein and/or as claimed as our invention. Minor variations will not avoid the use of the invention.

I claim as my invention:

1. A replaceable cutting element for use on the body of a earth-boring drag bit off center from the axis of rotation of said bit, the element comprising:

a contact structure including a cutting tip structure and a cutting tapered structure, the tip structure and the tapered structure being concentric with the overall element, a mounting structure supporting the tip and tapered structure; the contact structure is generally conical surrounding the tip structure with a generally obtuse included angle of the tapered structure.

2. A cutting element as defined in claim 1, further comprising an axially engageable structure.

3. A cutting element as defined in claim 1, wherein said axially engageable structure is a generally circular groove formed in the mounting structure.

4. A cutting element as in claim 1, wherein a portion of the tip structure is harder than 92 on the Rockwell A Scale and an outer portion of the tapered structure is softer than 92 on the Rockwell A Scale.

5. A cutting element as in claim 1, wherein the tip structure comprises a point.

6. A cutting element as in claim 1, including an engagable structure comprising:

a non-cylindrical surface engagable by an extraction tool.

7. A cutting element as set forth in claim 1, including:

a conical helical screw thread on the mounting structure concentric with the contact structure of the element.

8. A cutting element as in claim 1, wherein at least a portion of said tip structure is fabricated from one of a group of materials comprising diamond, a nitride of a metallic element, a carbide of a metallic element, an oxide of a metallic element carbide, a boride of at least one metallic element, a suicide of a metallic element, and carbon nitride.

9. An elongated self-locking replaceable cutting element for use on the body of a rotary earth-boring drag bit off center from the axis of rotation of said bit, the element comprising:

a contact structure comprising a cutting tip structure;

a mounting structure carrying the contact structure, and;

a conical helical screw thread on the mounting structure wherein, the cutting tip structure and the mounting structure are formed generally along the same axis, and a portion of said cutting tip structure is generally bilaterally symmetrical in at least three equally spaced radial directions from the axis of the element.

10. A cutting element as claimed in claim 9, wherein the included angle of the conical helix is between ½° and 60°.

11. A self-sharpening rotatable cutting element for use on the body of an earth-boring drag bit off center from the axis of rotation of said bit, the element comprising:

a contact structure including a cutting tip structure and a cutting tapered structure both being concentric with the overall element, the contact structure is generally conical with a generally obtuse included angle, a mounting structure carrying said cutting tip and tapered structure;

a non-cylindrical structure for the engagement and removal of the element;

a first material of wear resistance on the cutting tip;

a second region of material of a second wear resistance on the tapered structure fully surrounding and supporting the first material wherein the wear resistance of said first material is greater than the wear resistance of said second material, said tapered structure surrounds and generally converges with said tip structure;

a portion of said first material is generally contained within said second material;

a portion of the mounting structure is generally symmetrical in at lease three equally spaced radial dimensions, and;

the axis of the mounting structure is generally aligned with the axis of the tapered structure.

12. A cutting element as in claim 11, wherein said first material is in the form of a column positioned on the axis of the contact structure.

13. A cutting element as in claim 11, wherein the cross-sectioned area of said material of first hardness is less than 10% of the total cross-sectioned areas of the contact structure.

14. A cutting element as in claim 11, wherein the material of wear resistance on the tapered structure is at least 300 points softer than the wear resistant material of the cutting tip.

* * * * *

UNITED STATES PATENT AND TRADEMARK OFFICE

CERTIFICATE OF CORRECTION

PATENT NO. : 6,932,172 B2
DATED : August 23, 2005
INVENTOR(S) : Harold A. Dvorachek It is certified that error appears in the above-identified patent and that said Letters Patent is hereby corrected as shown below:

Column 12,
Line 14, the word "suicide" should be corrected to read -- silicide --.

Signed and Sealed this

Eighth Day of November, 2005

JON W. DUDAS
*Director of the United States Patent and Trademark Office*